US005356152A

United States Patent [19]

Curry

[11] Patent Number: 5,356,152

[45] Date of Patent: Oct. 18, 1994

[54] FOOTBALL BOARD GAME

[76] Inventor: Kevin P. Curry, R.R. #111, Claysville, Pa. 15323

[21] Appl. No.: 70,666

[22] Filed: Jun. 2, 1993

[51] Int. Cl.[5] ..... A63F 3/00

[52] U.S. Cl. ..... 273/247

[58] Field of Search ..... 273/297, 259, 94 R

[56] References Cited

U.S. PATENT DOCUMENTS

| | | | |
|---|---|---|---|
| 1,577,932 | 3/1926 | Palese | 273/94 R |
| 1,613,530 | 1/1927 | Peterson | 273/94 R |
| 2,245,830 | 6/1941 | Sheffield | 273/94 R |
| 3,222,068 | 12/1965 | Cowels | 273/247 |
| 4,211,410 | 7/1980 | Smith | 273/247 |
| 4,443,011 | 4/1984 | Sheridan | 273/247 |

FOREIGN PATENT DOCUMENTS

| | | | |
|---|---|---|---|
| 2201352 | 9/1988 | United Kingdom | 273/247 |

*Primary Examiner*—Benjamin H. Layno

[57] ABSTRACT

This invention provides a game in which the participants simulate plays in a football game according to a predetermined set of rules. Two sets of pegs represent various position players on each "football" team. The pegs fit snugly into holes placed equidistantly over an area representing a scaled version of a football field. The football field is made of a rigid flat board. the board is marked with horizontal lines representing yard line intervals which connect a pair of parallel vertical lines representing sidelines. Additionally, two rows of holes are adjacent to one sideline outside the field boundaries. Holes in these rows correspond to yard markers. Marker pegs fit into this row and allow players to keep track of forward progress and first downs. Three uniquely marked dice are provided. One die having an equal number of two distinct markings corresponding to each of two sets of pegs, or teams. The other two dice comprise a number die and a multiplier die. The number facing up on the number die is multiplied by another integer defined by a code. The code is one of three letters placed on the face of multiplier die. Each code letter appears a different number of times on the die faces. Participant rolls dice to determine the sequence and number of player moves its team will receive on a particular play, then moves the player pegs correspondingly.

2 Claims, 9 Drawing Sheets

| PEGSKIN YARD CARD | | | | |
|---|---|---|---|---|
| BALL ON | DOWN/YRD. TO GO | PLAY CALLED | PLAY RUN | YARDS GAIN/LOSS |
| | | | | |
| | | | | |
| | | | | |
| | | | | |
| | | | | |
| | | | | |
| | | | | |
| | | | | |
| | | | | |
| | | | | |
| | | | | |
| | | | | |
| | | | | |
| | | | | |
| | | | | |
| | | | | |
| | | | | |
| | | | | |

FIG. 14A

| PEGSKIN YARD CARD | | | | |
|---|---|---|---|---|
| BALL ON | DOWN/YRD. TO GO | PLAY CALLED | PLAY RUN | YARDS GAIN/LOSS |
| RED 20 | 1/10 | RUN LEFT | | |
| | | | | |
| | | | | |
| | | | | |
| | | | | |

FIG. 14B

| PEGSKIN YARD CARD | | | | |
|---|---|---|---|---|
| BALL ON | DOWN/YRD. TO GO | PLAY CALLED | PLAY RUN | YARDS GAIN/LOSS |
| RED 20 | 1/10 | RUN LEFT | RUN LEFT | +3 |
| RED 23 | 2/7 | | | |
| | | | | |
| | | | | |
| | | | | |

FIG. 14C

FOOTBALL BOARD GAME

FIELD OF INVENTION

Pegskin Football is an invention relating to a football type board game where each roll of the dice produces an ever changing game of strategies simulating a single football play.

PRIOR ART

In the evolution of football games Pegskin Football is the most advanced in its design of how the game is played. There has never been a football board game designed where the two opponents have had as much control in the outcome of each play. In previous games there were predesigned plays or vibrating fields with no control over player movement. Control ended when you "flicked the switch" or compared plays based on prewritten offensive and defensive play outcomes and by moving a yardage marker on a simulated football field. This does not allow for the multiplicities of outcomes as provided in Pegskin Football In fact, you have control of all eleven men on your football team. for each roll of the dice. With Pegskin Football each player can be moved strategically throughout each football play and is not committed to a set play (pass or run) until the ball carrier reaches the line of scrimmage.

OBJECT OF THE INVENTION

Pegskin Football is a uniquely designed football game where you are the coach of an almost perfect team. There are no fumbles or penalties. A perfect chalkboard environment. However, there are interceptions and incompletions due to variables in football player movement. Statistically, a passing play is not completed 100% of the time as a result of the many variables in defensive coverage causing a change in the probability of successfully completing the pass play.

Player movement is restricted similar to that of a chess game. So the coach must be able to plan player moves in advance, always keeping in mind his opponents moves. The player moves are determined by using specially marked dice. The better the roll of the dice, the better move you can make to execute your play. This game was designed to create football plays and not necessarily a full four quarter football game. A coach sets a play and rolls the dice to move the football players. Each play may take up to five minutes to complete. Therefore, a full four quarter game could take a long time but is not out of the question. Since this game is designed to create football plays, the objective of winning could be determined in a number of ways such as yardage statistics for a set number of plays for each coach, or by using a four quarter format, as in a regular football game, which requires more time. These and other ways are described in more detail later.

BRIEF DESCRIPTION OF DRAWINGS

FIG. 14: Pegskin football Yard Card
14*a*: Yard Card before a play is run
14*b*: Yard Card after a play is run

DESCRIPTION OF THE PREFERRED EMBODIMENT OF THE INVENTION

Pegskin Football Playing Board

Figure 1:
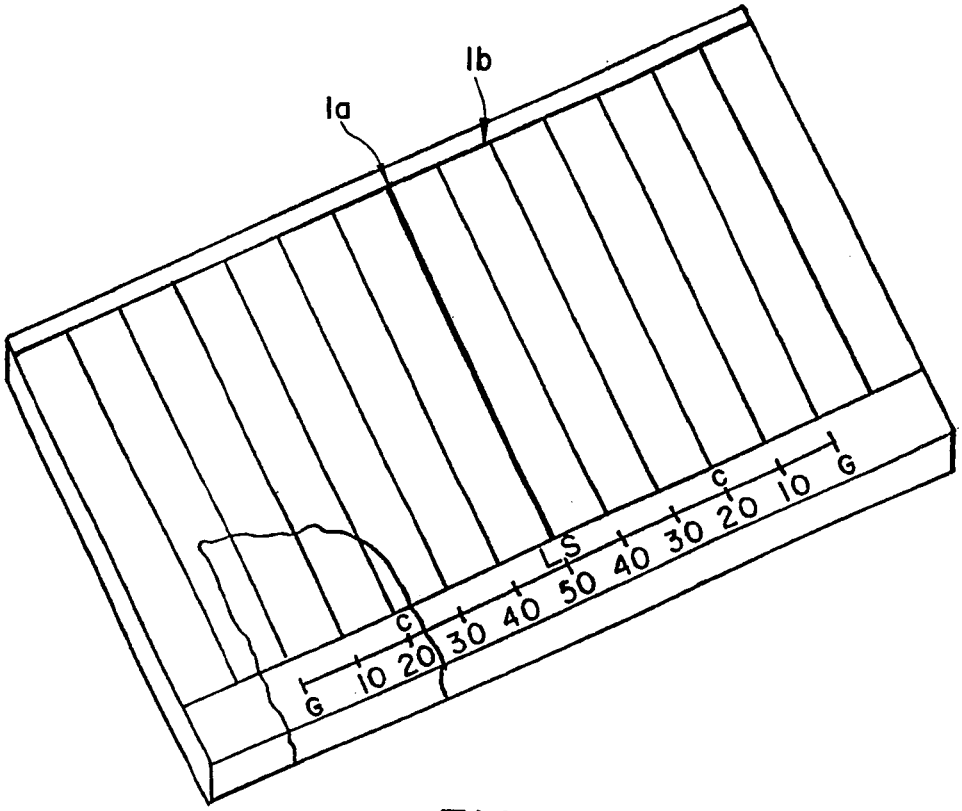
FIG. 1: Full view of board apparatus
1*a*: including line of scrimmage, LS
1*b*: continuing line or C-line
Figure 2:
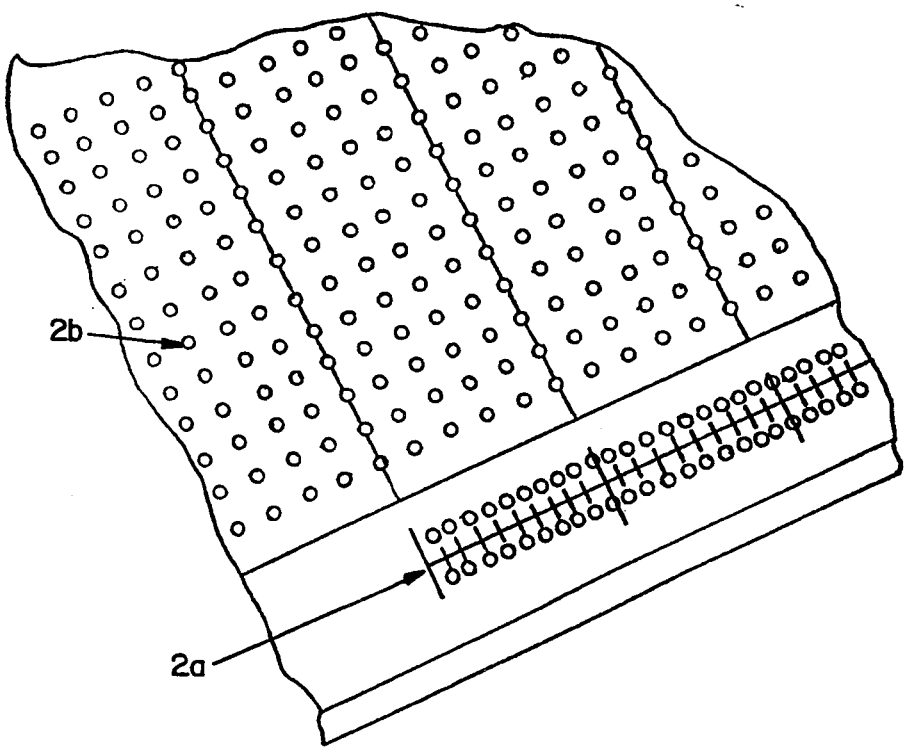
FIG. 2: Blow up section of FIG. 1
2*a*: side line gauge
2*b*: equidistant holes shown in detail
Figure 3A:
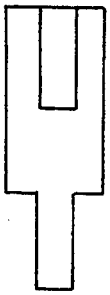
FIG. 3: Peg design
3*a*: sectional view
3*b*: top & bottom view
3*c*: ¾ view away
3*d*: ¾ view facing
Figure 3B:
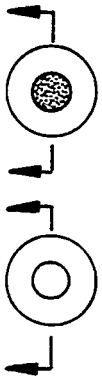
Figure 3C:
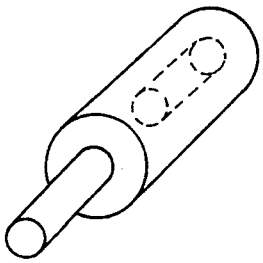
Figure 3D:
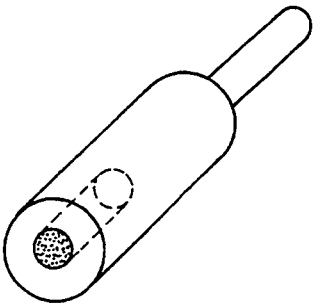
Figure 4A:
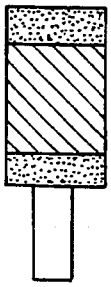
FIG. 4: Player denotation design
4*a*: 2 stripe lineman peg
4*b*: 3 stripe ball handler peg
4*c*: 4 stripe ball handler peg
4*d*: "ball on" marker used on sideline gauge
4*e*: 10 yard first down marker used on sideline gauge
4*f*: football peg
Figure 4B:
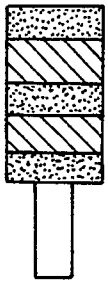
Figure 4C:
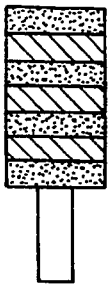
Figure 4D:
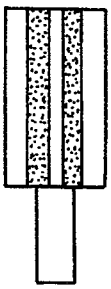
Figure 4E:
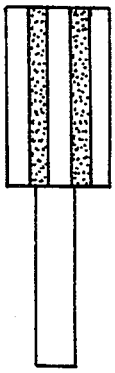
Figure 4F:
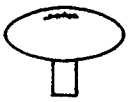

The board FIG. 1 is used as a playing field. Holes in the board are used to set-up pegs or 'players for each down. Each space/hole represents a one yard peg movement. Although the field is not 100 spaces in length, or 50 spaces wide, it is designed to run individual plays. Game progress is tracked on the 100 yard gauge on the sideline and the Pegskin Football Yardcards. (These will be discussed in more detail later). All plays are started at the line of scrimmage solid line at midfield. 1*a*). This allows for large gains or losses. Should a play run to the end of the board, the ballcarrying piece is returned to a continuation line (C line or broken line. 1*b*) at the same point of distance from the sidelines when the player reached the end of the board. The defender in pursuit of the ballcarrier follows the same rule. The ballcarrier continues until he is tackled or enough yardage is gained to reach the end-zone, as designated by the sideline gauge. 2*a*.

The game board of Pegskin Football is a perfectly flat, rectangular board approximately 24"×36"0 with holes that are symmetrically spaced. However, the game board can be adjusted to accommodate any shape and any other dimensions whether larger or smaller. Materials used to construct the game board and playing pieces were wood, plastics, and metal, however, it is to be understood that other materials suitable for both the game board and playing pieces can be substituted. These materials include but are not limited to electronic or computer related materials, or to those mentioned above.

Football Players

The colored pegs are used as players FIGS. 3&4. Each team consists of 11 players. The following combination of pieces makes an eleven man offense. Five offensive lineman and six ball handlers (4 of which are offensive backs—QB's, running backs and tightends FIG. 4*b*—and 2 of which are receivers FIG. 4*c*). The linemen can only block and are ineligible to handle the ball. These players have two stripes FIG. 4*a*. The four offensive backs and the two receivers can block as well as carry the ball or catch a pass. These players have three and four stripes respectively. Wide receivers can be placed in runningback positions during play set-up. The defensive team uses the same kind of pegs.

Player Movement

Figure 5:
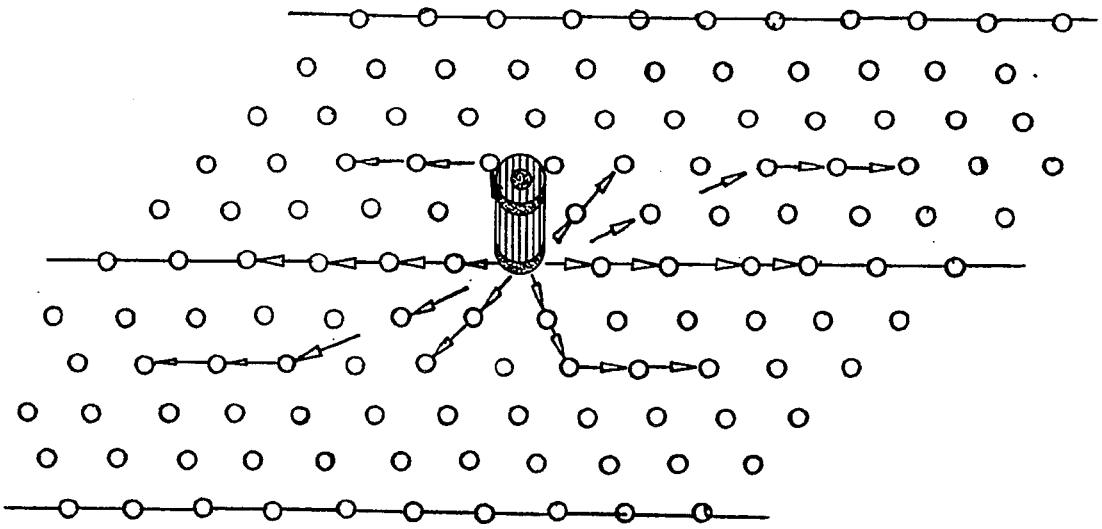
FIG. 5: Player movement

Offensive and defensive players may be moved a maximum of four holes. They may move 4 holes laterally in either direction, two holes forward or backward, or any combination for each roll of the dice during 'line play (the time prior to declaring run or pass) including diagonal movement FIG. 5.

Figure 6:
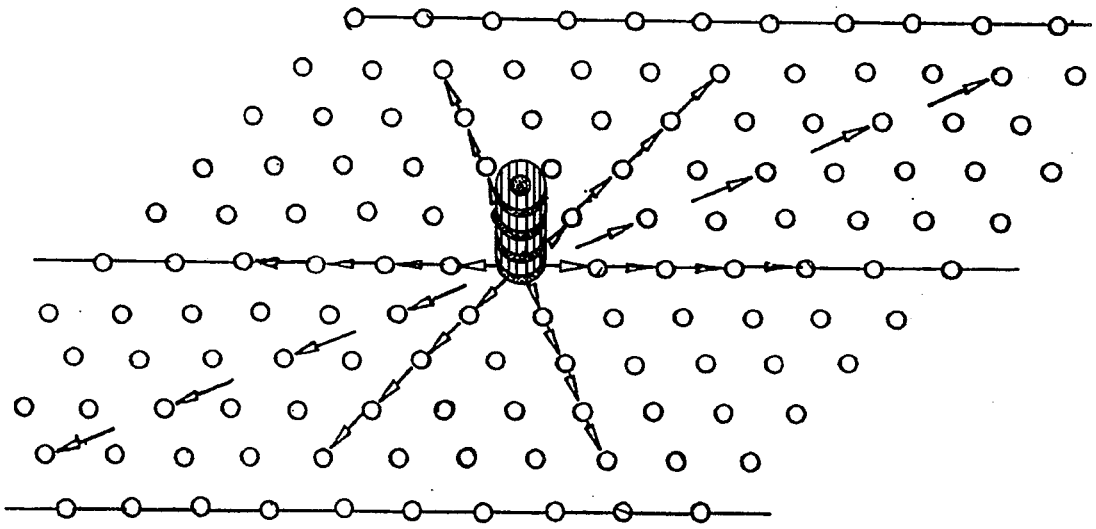
FIG. 6: Exception to player movement in FIG. 5—wide receiver movement-defensive 4 stripe movement not shown.

The two exceptions to this rule applies to the offensive and defensive players with four stripes. The offensive players can move a maximum of four holes in any direction—FIG. 6—and the defensive players can move a maximum of three spaces forward or backward. However, they are allowed to move 4 spaces laterally as always.

Once a wide receiver or other ball handler reaches 5 yards from the line of scrimmage, the illegal chuck rule applies and the 'receiver' may not be blocked by a defensive peg but only 'covered'. Movement of the pegs/-players is determined by rolling the specially marked dice.

Playing Dice

Figure 7A:
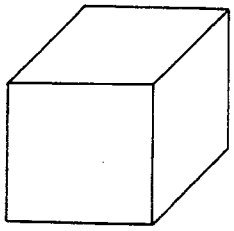
FIG. 7: Playing dice
7*a*: dice design
7*b*: black and white die
7*c*: SDT die
7*d*: Numbered die
Figure 7B:
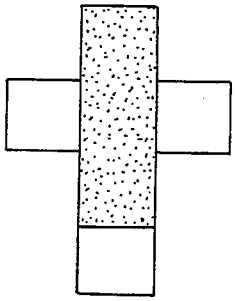

There are five die used in the game which are 6 equally sided cubes. One white and black colored die (offense/defense die) that is rolled by the offensive coach at the beginning of each play to determine which team gets the first move of that football play. FIG. 7*b*

Prior to rolling the Offense/Defense die, the offensive coach can send a man in motion and the defensive coach can counter this move (explained in more detail in 'Start of Play' section) If black is rolled, defense rolls the line play dice first and moves his players accordingly. If white is rolled, offense goes first.

Figure 7C:
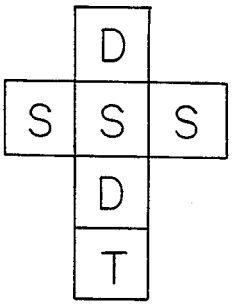
Figure 7D:
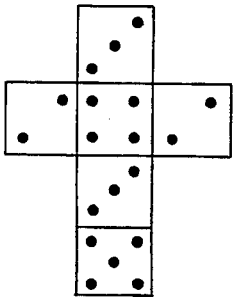

The remaining four dice, two for each team, are continually used by the coaches to determine player movement, and pass or pitch completion. Each coach gets one numbered die FIG. 7*d* and one SDT die FIG. 7*c*. The SDT die has three sides marked with an S, two sides marked with a D, and one side marked with a T. The numbered die has two sides marked with a 2, two sides marked with a 3, one side marked with a 4, and one side marked with a 5. To calculate the number of team moves, both dice are rolled simultaneously. The number showing on the numbered die is multiplied by 1, 2, or 3, depending on the outcome of the SDT die (S=1, D=2, T=3).

For example, if a coach rolls S2, he would have a total of two team moves. A roll of D4 would be a total of eight team moves. Team moves consist of total player movements keeping in mind the player movement restrictions as mentioned earlier. There may be times when a team cannot use or does not want to use the maximum number of moves that the roll of dice allows.

During line play both dice are rolled. This is the period of play after rolling the Offense/Defense die and prior to the time the offensive coach declares his play—run or pass. Line play can consist of a minimum of 1 offensive roll or many rolls, further developing the play. In other words, as long as the ball carrier has not reached or crossed over the line of scrimmage due to a pass or run. Once a ball carrier reaches the line of scrimmage, or if all players other than the ball carrier are blocked, the play automatically becomes a run. However, the offensive coach can choose to roll both dice until all players, other than the last ball handler, have been used for a block.

Once the ball carrier has reached or crossed the line of scrimmage only the numbered die can be used to move a player. The offense must roll both dice at least once before declaring run or pass. Additionally, the defense gets to roll both dice every time the offense rolls both dice. During line play only, a peg can be moved a maximum of four spaces. Therefore, if a team rolls DS, the coach has a total of 10 team moves and may move ten players one space (1 yard) each or two players may be moved four spaces each and one player two spaces for a total of ten moves.

Blocking

Figure 8:
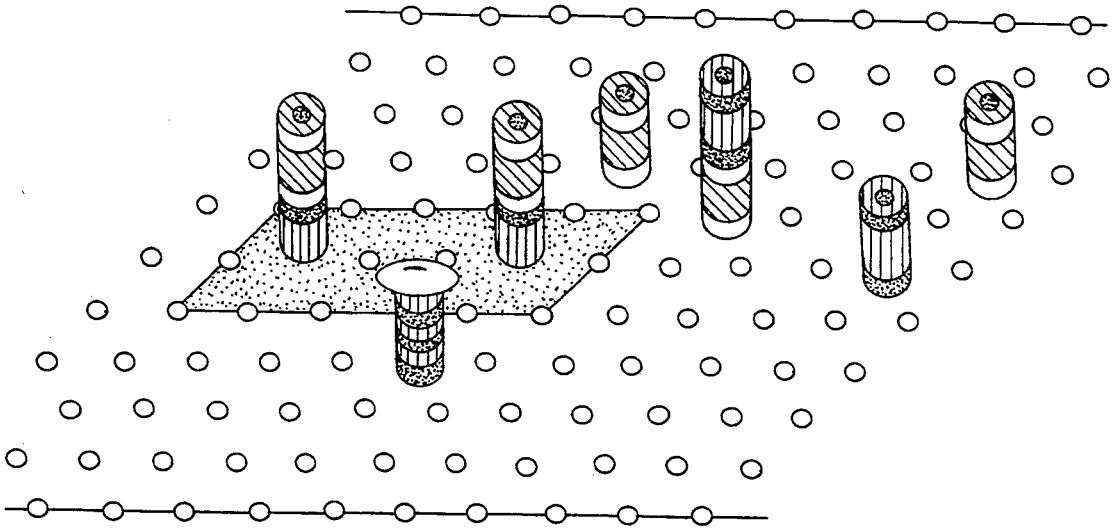
FIG. 8: Blocking example
8*a*: blocked zone

Blocking can only occur during line play. Therefore, blocking should be completed prior to the offense declaring run or pass. A block is accomplished by moving a peg to the same location as an opponent 10 peg and placing your peg on top of your opponents peg. The team that makes the block controls the area around the block (1 space in any direction) FIG. 8. Once a block occurs, these pegs can no longer be moved during this play. Keep in mind the "illegal chuck rule". After offensive ball handlers have gone five or more yards down field, defensive players cannot block but only 'cover' the offensive peg.

Start of Play

Opponents may flip a coin to decide which coach is offense and defense at the start of a game.

Figure 9:
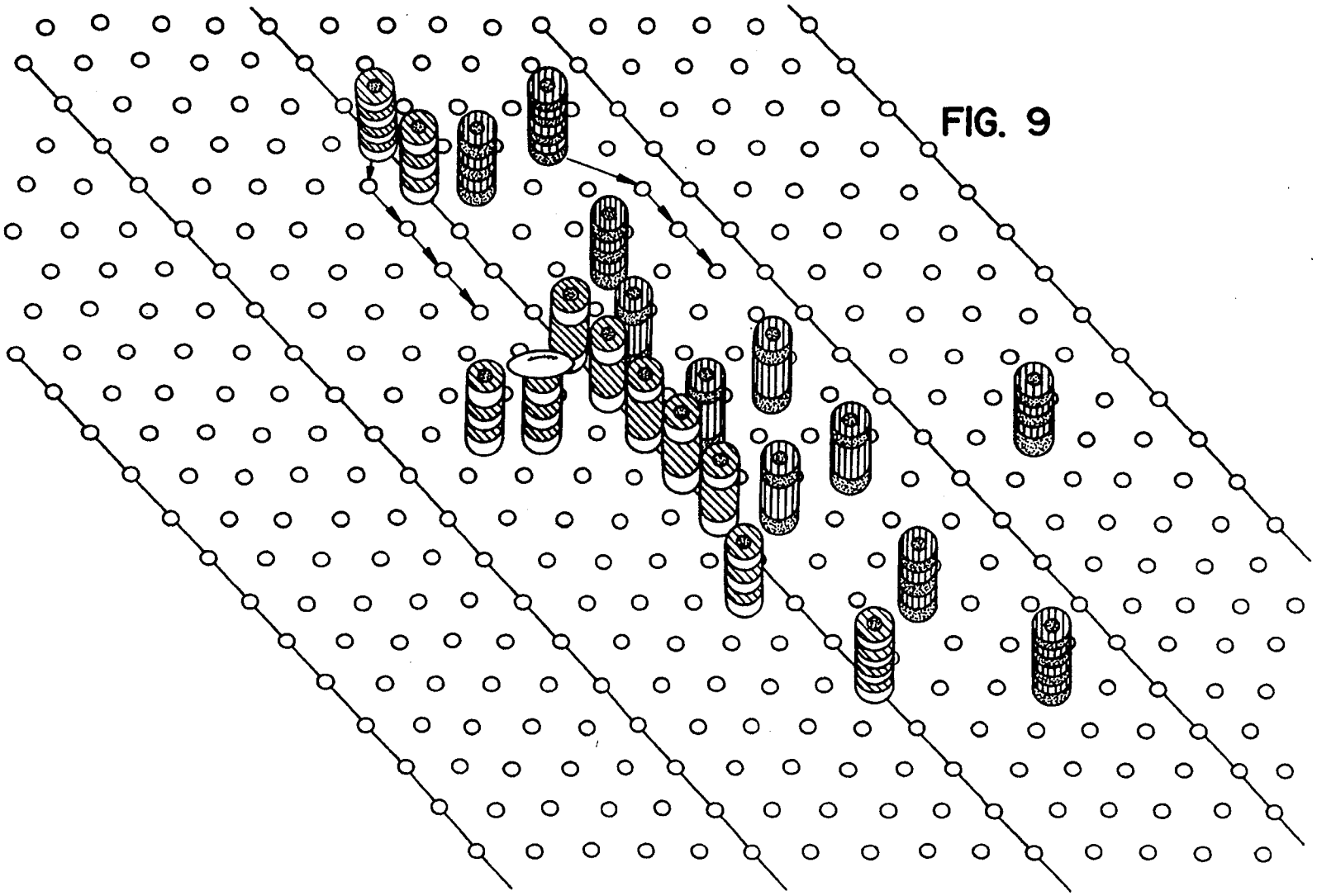
FIG. 9: Depiction of the motion rule
9*a*: offensive motion
9*b*: defensive motion

The offensive coach sets his players (pegs) at the line of scrimmage according to his playbook or by using a play he saw in a real game the Sunday before. Remember, 7 men minimum on the line of scrimmage FIG. 9.

The defensive coach now sets his players to counter what was seen while watching films of his opponent during the previous week. Once both teams have been set-up, the defensive coach asks if the offensive coach is going to put a player in motion. Offense may now put one man in motion if this is part of his "play" FIG. 9*a*. If the player is on the line of scrimmage, he must move one space backward (straight back, to the left, or to the right and diagonal) and a maximum of four spaces laterally from his starting position. Any player behind the line of scrimmage may use the same movement as a player that started from the line of scrimmage but does not have to take one step backward. If the defense is in a blitz formation, the QB may move straight back 2 spaces into a shotgun position.

The defense can now counter, having a total of three team moves to be used in any combination. One peg forward, backward, or laterally three spaces or three players one space in any direction FIG. 9*b*. If the offense chooses not to send a man in motion, the defense still has the option to use his 'motion' moves.

Start of Line Play

After each team has had the chance to move a player in motion, the offensive coach rolls the black & white die 7*b* to see which team starts the line play. This will determine who controls the line of scrimmage. As mentioned earlier, line play is the period of player movement prior to the offensive coach declaring run or pass. If the offensive ball carrier reaches the line of scrimmage, the play automatically becomes a run. The offense must roll both dice at least once before declaring his play and the defense always receives a counter roll using both dice. Therefore, if black is rolled, the defense wins the roll of the black & white die and the defensive coach rolls the line play dice first. Then the offense rolls next and the defense must counter the offensive roll for a minimum of three rolls in this example. At this point, the offensive coach must decide to continue line play, pass, or run. The offense may roll the line play dice until the ball carrier is the only unblocked player or until he decides to run or pass. The defense will always be the last to roll the line play dice because the offensive coach must declare run or pass at the start of his turn.

Handoffs & Pitch-outs

Figure 10:
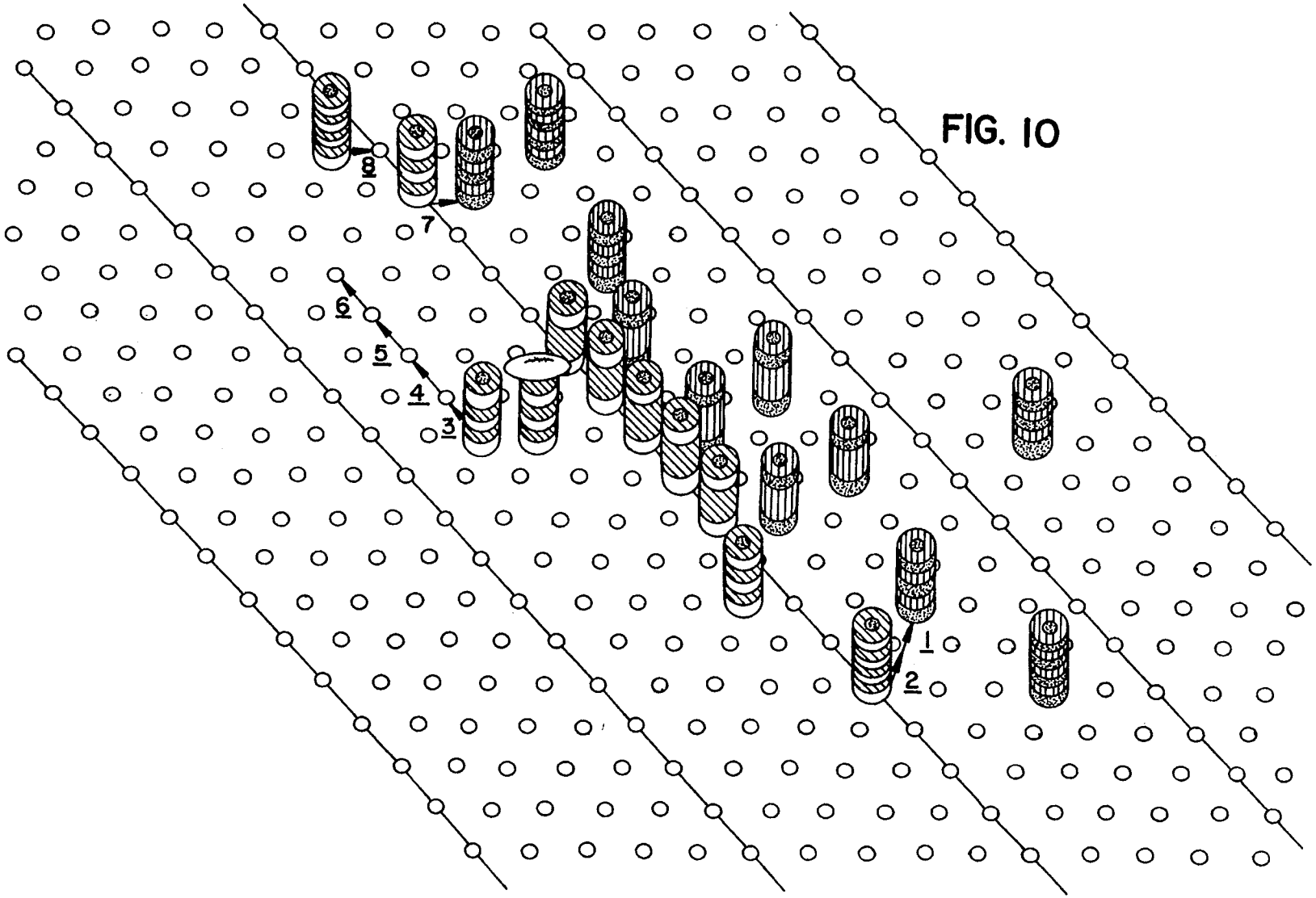
FIG. 10: Depiction of the handoff rule using 8 team moves
10*a*: first 2 of 8 moves (Offensive move to block defense)
10*b*: Handoff
10*c*: moves 3–6 of 8
10*d*: last 2 moves of 8 (move number 7 is offense blocking defense)
Figure 11:
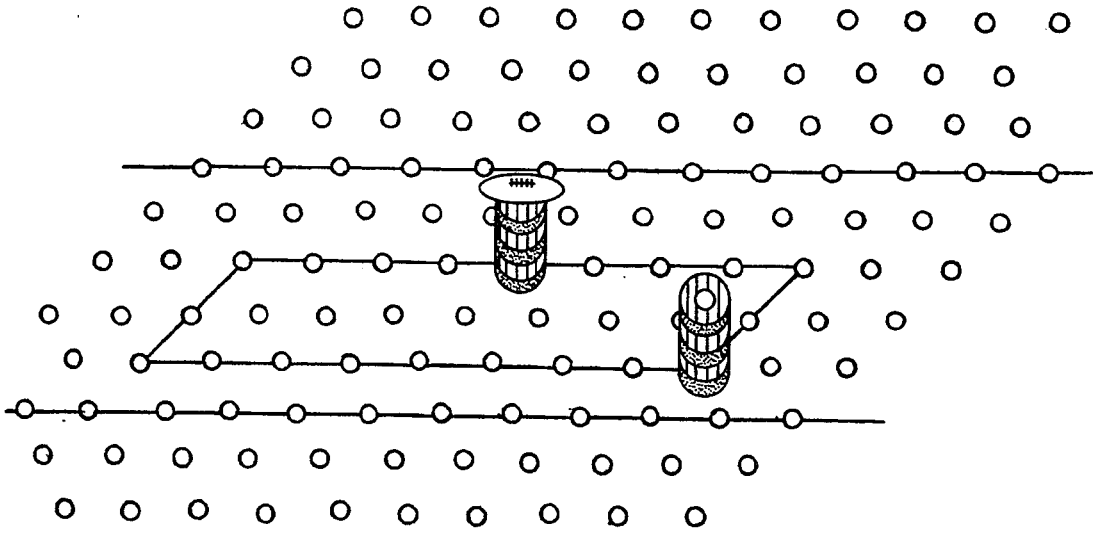
FIG. 11: Legal pitch-out zone

Handoffs and pitch-outs are done during line play. For example, if D4 is rolled, the offense has 8 total team player moves. The coach can use two of his team moves, handoff or pitch the ball, then use his remaining six team moves. No team moves are used to handoff or pitch the ball. In order for a player to handoff the ball to another player, the ball handler receiving the handoff must be within one space in any direction from the peg with the ball FIG. 10*b*. In other words, there cannot be any spaces between players. For a pitch-out, the intended receiver of a pitch-out must be either on the same lateral line as the ball carrier or no more than 2 spaces back as well as only 4 spaces to the left or right FIG. 11. A pitch or handoff can only be done behind the line of scrimmage.

Figure 12:
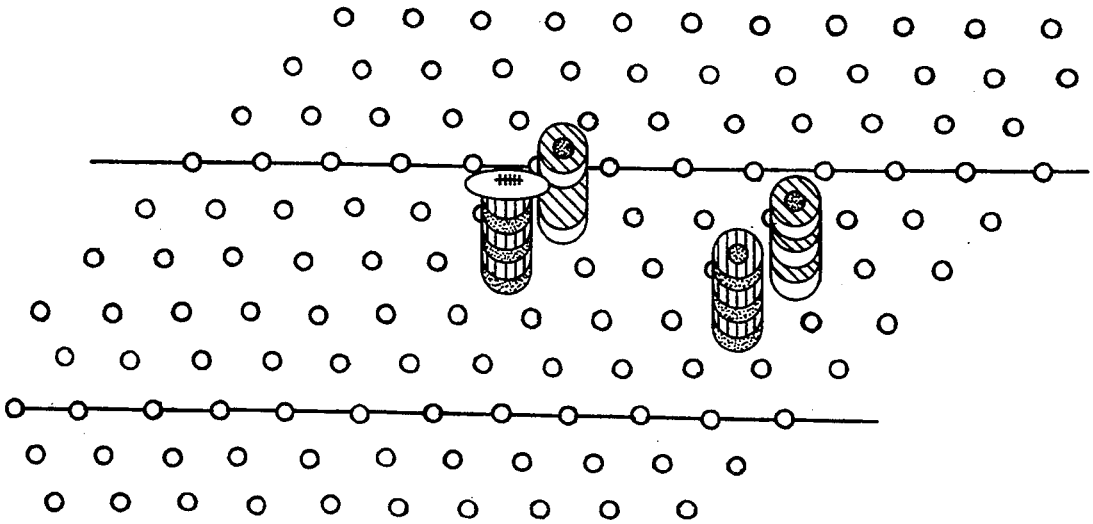
FIG. 12: Pitch-out with defensive coverage

The SDT die is rolled by itself to determined if the pith is complete. As in regular football, the odds are very good but not 100%. If an S or D are rolled the pitch is complete. If a T is rolled, one of three situations occur. First, if there are no defenders within one space of either the pitching or the receiving offensive peg, the pitch would be incomplete and the ball would be down where the pitching peg stands FIG. 11. However, if the defense has a peg within one space of the offensive player pitching the ball, it is a loss of yardage or sack FIG. 12. If the defensive peg is within one space of the receiving offensive player and a T is rolled, the pitch is intercepted FIG. 12

The Run

When the offensive coach declares run at the beginning of his turn, line play is complete and only the numbered die is used, by both coaches, to determine the number of moves for the ball carrier and the defenders (any unblocked player) in pursuit. For the offensive team, only the ball carrier may be moved from now until the end of the play. However, there are now no restrictions on the amount of forward or lateral moves for either team's players. Both players (pegs) can now move 2–5 spaces depending on their roll. The rolling of the numbered die continues until the ball carrier is tackled or scores a touchdown.

The Pass

Figure 13A:
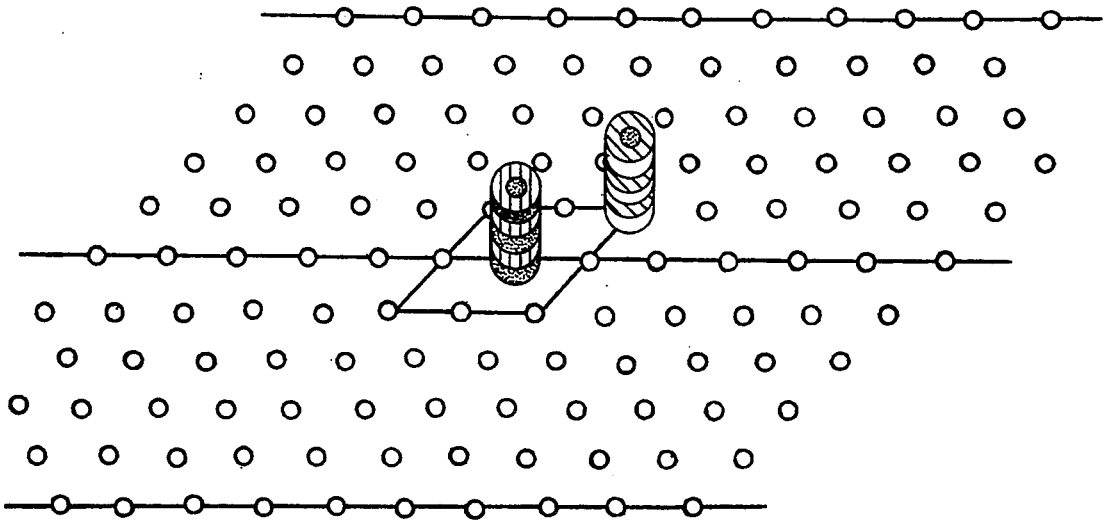
FIG. 13*a*: Defensive pass coverage within one space of offense
13*b*: Defensive pass coverage within three spaces of offense

If the offensive coach declares pass, again line play is complete and the SDT die is used to determine pass completion. Depending on the defensive coverage, completions are as follows:

If an unblocked defensive peg is within one space of the intended receiver, an S is incomplete, a D is intercepted and a T is complete. This follows closely the probabilities completion in a real football game based on good defensive coverage FIG. 13*a*

Figure 13B:
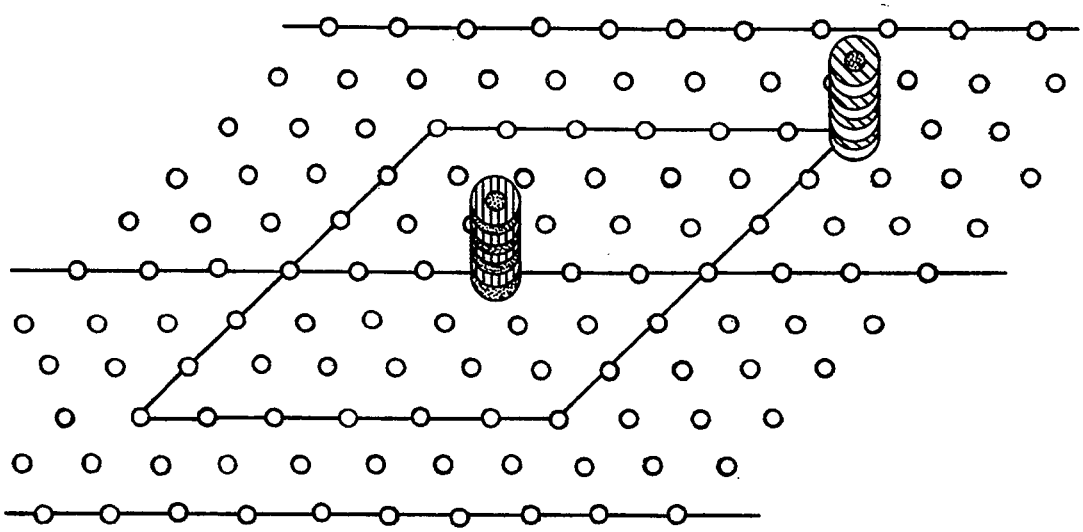

If a defender is not within one space but is no further than three spaces, an S is complete, a D is incomplete, and a T is intercepted FIG. 13*b*

If the defender is not within three spaces of the receiver an S is complete, a D is incomplete, and a T is incomplete. If the defensive team has a player within one space of the passing peg and a T is rolled, the passer is sacked for lost yardage. However, if both the passing and receiving pegs have a defender within one space and a T is rolled, the first rule applies and the pass is complete.

Once the pass is completed, the defender now rolls only the numbered die to start his pursuit of the receiver and from this point both coaches roll only the numbered die as was stated in the section The Run.

Pegskin Football Yard Card

The Yard Card is used to keep Statistics that will determine how accomplished each coach is against his opponent. Statistics such as the total yards or the number of first downs are gained in each scrimmage or ball possession.

After a play is completed, the offensive team records the play description and the number of yards gained or lost. Additionally, the new down, yards-to-go, and ball-on statistics are recorded before the next play. For example, if the offense ran the ball for a three yard gain, the Yard Card would look like FIG. 14*b*.

Full 4 Quarter Game

A full four quarter game can be played, if desired, and could take as much as 6 hours if the coaches do not impose limitations on player movement decisions. However, as a coach becomes more familiar with the peg movements and rules, playing time is reduced greatly. The following rules apply when playing a full game:

1. All kickoffs are assumed out of the end-zone and play starts at the 20 yard line.
2. Each quarter consists of either 20, 24, or 28 plays total, depending on the length of time is desired by each of the two coaches. This is the preferred method of playing time but is not limited to this type or number of plays.
3. If a coach decides to punt the ball, he must roll the numbered die twice with the outcome as follows:
   * Multiply the first roll by ten (10) and add to that the second roll plus five more to that number. For example, if the first roll is a 4 and the second roll is a 3 the total yardage for this punt would be 48 yards. ($4\times10=40$ plus the second roll of $3+5=8$.)
4. The punt return team rolls the SDT die and the numbered die calculating the outcome of the return in the same way it is calculated in the section describing line play.
5. Fourth down punt plays are included in the total number of plays per quarter as determined by the coaches.
6. If a team is in fieldgoal range and the coach wants to go for 3 points, he rolls both SDT dice and the following applies:

| | |
|---|---|
| 0-10 yds. from goal | Anything but T T |
| 11-20 yds. from goal | Anything but T T and D T |
| 21-30 yds. from goal | Only SS and SD are good |
| 31-40 yds. from goal | Only SS is good |
| 41-50 yds. from goal | Only T T is good |

It will therefore be seen that the scope of the invention provides a highly playable game between two opponents that closely simulates the conventional game of football. However, the scope of the invention should be determined not by the embodiment illustrated but by the appended claims and their legal equivalents. The particular embodiment chosen here is by way of illustration and meant to be in no way restrictive.

I claim:

1. A football board game apparatus for simulating single football plays where said plays may be compiled to simulate a full football game or used in any other combination that would constitute a full game as determined by two opponents;

Said board apparatus comprising a football playing area including a first plurality of equidistant holes for marking locations on said playing area;

a second plurality of equidistant holes for marking individual movement and location of said pegs on said playing area;

a plurality of pegs divided by color code into a pair of matching sets, each said set of pegs representing an imaginary football team;

random selecting means for determining range of movement of said pegs through said plurality of locations;

wherein first said random selecting means includes a cubic die with an equal number of two different color markings, each color corresponding to the color of one set of pegs indicated thereon to determine which of the opposing sets of pegs moves first in the play of said game;

second said random selecting means including a cubic die having at least three distinct letters displayed thereon, a first letter being displayed singularly on three sides, a second said letter being displayed singularly on two sides, and a third said letter being displayed singularly on the remaining side;

third said random selecting means including a cubic die having four integers displayed thereon, wherein each of the two lowest integers being displayed singularly on two sides of said die and the remaining integers each being displayed singularly on a side of said die;

said letter displayed on the upward face of said second die corresponding to an integer value multiplied with the integer displayed on the upward facing side of said third die to form a product which determines the number of player moves allocated to the participants; and a football piece including means for removably attaching said piece to a selected one of said pegs to indicate the peg having possession of the football.

2. A football game apparatus comprising:

a game board having surface area representative of a football field;

said game board including a field portion and a sideline portion;

said field portion being generally rectangular, and bounded on two long sides by sidelines and on two short sides by end lines;

a plurality of holes spaced equidistantly apart on said field portion in the area bounded by said sidelines and said endlines;

line segments traversing in spaced relation said field portion to connect said sidelines;

said sideline portion being outside of said field portion adjacent to one of said sidelines, said sideline portion including holes spaced in regular intervals along a line parallel with said sidelines;

a plurality of pegs divided into two colored sets, each peg having a protruding pin for detachably securing said peg in any hole in said field portion; each peg having at least one stripe for identification of said peg as a player position;

three cubic dice for randomly selecting a combination of outcomes, a first die having an equal number of two different color markings, each color corresponding to one set of pegs;

a second die having at least three distinct letters displayed thereon, a first letter being displayed singularly on three sides, a second letter being displayed singularly on two sides, and a third letter being displayed singularly on the remaining side;

a third die having four integers displayed thereon wherein each of the two lowest integers are displayed singularly on two sides of said die and the remaining integers are displayed singularly on another side of said die;

a football; and means for removably attaching said football to any one of said pegs.

* * * * *